United States Patent [19]

Nakai

[11] Patent Number: 4,509,693

[45] Date of Patent: Apr. 9, 1985

[54] ELECTROMAGNETIC FUEL INJECTOR

[75] Inventor: Kenji Nakai, Obu, Japan

[73] Assignee: Aisan Kogyo Kabushiki Kaisha, Obu, Japan

[21] Appl. No.: 463,013

[22] Filed: Feb. 1, 1983

[30] Foreign Application Priority Data

Feb. 18, 1982 [JP] Japan ..... 57-23218[U]

[51] Int. Cl.[3] ..... B05B 1/30

[52] U.S. Cl. ..... 239/585; 251/141

[58] Field of Search ..... 251/139, 140, 141; 239/585

[56] References Cited

U.S. PATENT DOCUMENTS

| | | | |
|---|---|---|---|
| 3,235,223 | 2/1966 | Wontriss | 251/141 |
| 3,241,005 | 3/1966 | Morris | 251/141 |
| 4,132,194 | 1/1979 | Saito | 251/141 |

FOREIGN PATENT DOCUMENTS

| | | | |
|---|---|---|---|
| 545414 | 7/1980 | Japan | 239/585 |

*Primary Examiner*—Jeffrey V. Nase
*Assistant Examiner*—Kevin P. Weldon
*Attorney, Agent, or Firm*—Dennison, Meserole, Pollack & Scheiner

[57] ABSTRACT

An electromagnetic fuel injector for an internal combustion engine comprising a non-magnetic spacer fixed to the rear end of the armature for cutting off the residual magnetism of the fixed magnet core and a ferromagnetic spacer having a fixed thickness interposed between the abutting surface of the valve housing and the electromagnetic housing. The front end of the fixed magnet core is disposed from the position flush with the abutting surface of said electromagnetic housing to the position retracted rearwardly from the abutting surface of the electromagnetic housing by the distance of the stroke of said valve body. The rear end of the armature and the abutting surface of the valve housing are adjusted to provide a maximum stroke of the valve body.

2 Claims, 4 Drawing Figures

ELECTROMAGNETIC FUEL INJECTOR

BACKGROUND OF THE INVENTION

This invention relates to an electromagnetic fuel injector for use in an electronically controlled fuel injection system of a single- or multiple-point type for an internal combustion engine in an automotive vehicle.

FIG. 1 shows a vertical sectional view of a conventional electromagnetic fuel injector designated by reference number 1. The electromagnetic fuel injector 1 is provided with a fuel injection nozzle 3 at its front end. A valve housing 2 is provided with a fuel passage 4 extending along its axis, and a plunger-like valve body 5 is inserted into the fuel passage 4. An armature 6 is fixed to the rear end of the valve body 5. The valve housing 2 is retained by an electromagnetic housing 7 at its front position. A fixed magnet core 8 and an exciting coil or winding 9 are accommodated in the electromagnetic housing 7 at its rear portion. In response to the control signal inputted from a terminal 10 to the exciting coil 9, the valve body 5 is effective to axially reciprocate for discharging pressurized liquid fuel from the fuel injection nozzle 3. The inner surface of the nozzle 3 serves as a valve seat 3*a* which is adapted to come into contact with a valve member 5*a* of the valve body 5. The cylindrical inner surface of the fuel passage 4 serves to guide a slide portion of the valve body 5. The front portion of the valve housing 2 is protected by a cover 7*a* and the rear portion thereof is fixed to the front portion of the electromagnetic housing 7 with an O-ring seal 11 and a non-magnetic spacer 12 interposed. The outer circumference of the valve body 5 is formed with a flange 5*b* on the front side of the spacer 12, and the flange 5*b* is adapted to come in to contact with the front surface of the spacer 12 when the valve body 5 moves up to the rearmost position. The electromagnetic housing 7 as a yoke is formed of a ferromagnetic material, and the exciting coil 9 is housed in a space between the electromagnetic housing 7 and the fixed magnet core 8 with O-ring seals 13 and 14 interposed. The fixed magnet core 8 is also formed of a ferromagnetic material and is provided with an axial through-hole as a fuel passage 15. A compression spring 16 is inserted into the front portion of the axial through-hole so as to normally bias against the rear end of the armature 6 and hold the valve body 5 in a closed position. The compression spring 16 abuts against the front end of a sleeve 17 which is carried in the axial through-hole of the fixed magnet core 8. A fuel filter 18 is provided at the rear end of the fuel passage 15.

The stroke S of the valve body 5 is determined in such a manner that the valve body 5 abuts against the valve seat 3*a* and both positions of the rear end of the valve housing 2 and the rear end of the valve flange 5*b* are so suitably adjusted as for the distance between both of the rear ends to become S. An air gap D is defined between the rear end of the armature 6 and the front end of the fixed magnet core 8 so as for the valve body 5 not to be influenced by the residual magnetism of the fixed magnet core 8 when the valve body 5 moves forwardly from its opening position. In order to suitably select the spacer 12, the combination size A of the electromagnetic housing 7 and the fixed magnet core 8, and the combination size B of the valve housing 2, the flange 5*b* and the armature 6 are respectively measured, and the thickness $C=(B+D)-A$ of the spacer 12 is calculated. The size A is the combination of two elements, and it is hard to accurately measure the axial dimension of the central bore. The size B is the combination of three elements, and it is also hard to accurately measure the axial dimension of the central bore since the valve housing 2 and the valve body 5 are not fixed. In the case that the thickness of the spacer 12 is selected after measurement of the sizes A and B, the problem seems to be that many kinds of spacers 12 must be prepared per one micro meter so as to increase the accuracy of the size D.

SUMMARY OF THE INVENTION

Accordingly, it is an object of the present invention to provide an electromagnetic fuel injector which eliminates the above-mentioned difficulties arising during manufacture thereof and decreases the manufacturing costs.

It is another object of the present invention to provide an electromagnetic fuel injector which may determine the stroke of the valve body and the air gap with a high degree of accuracy, thereby improving the injection characteristics.

According to the present invention, a spacer is fixed to the rear end of the armature for cutting off the residual magnetism of the fixed magnet core. Another spacer having a fixed thickness is interposed between the abutting surface of the valve housing and the electromagnetic housing. The front end of the fixed magnet core is disposed from the position flush with the abutting surface of said electromagnetic housing to the position retracted rearwardly from the abutting surface of the electromagnetic housing by the distance of the stroke of the valve body. The rear end of the armature and the abutting surface of the valve housing are adjusted to provide a maximum stroke of the valve body.

Various general and specific objects, advantages and aspects of the invention will become apparent when reference is made to the following detailed description of the invention considered in conjunction with the related accompanying drawings.

DETAILED DESCRIPTION OF THE PREFERRED EMBODIMENTS AND MODIFIED FORMS THEREOF

Figure 1:
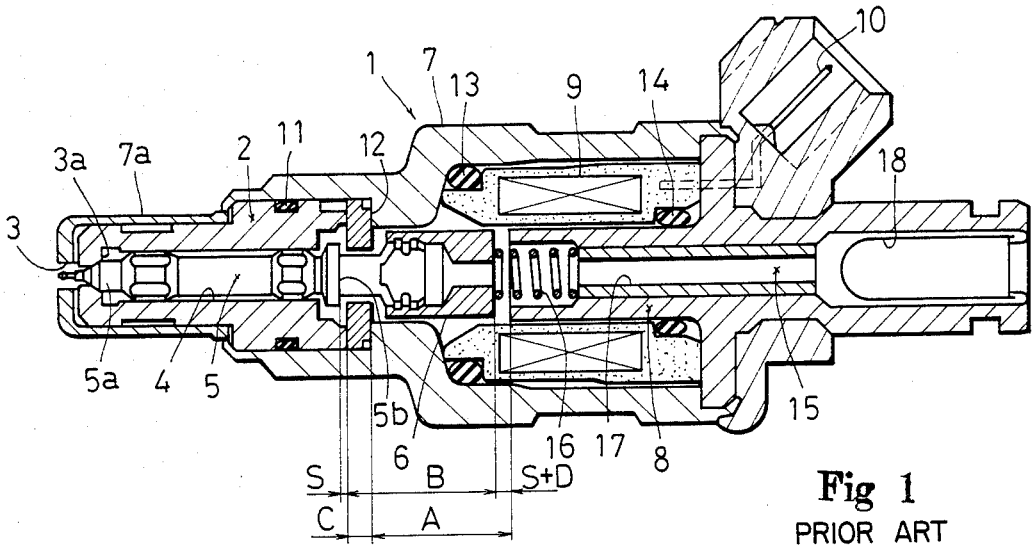
Fig 1 PRIOR ART
FIG. 1 is a vertical cross-sectional view of an electromagnetic fuel injector in the prior art.
Figure 2:
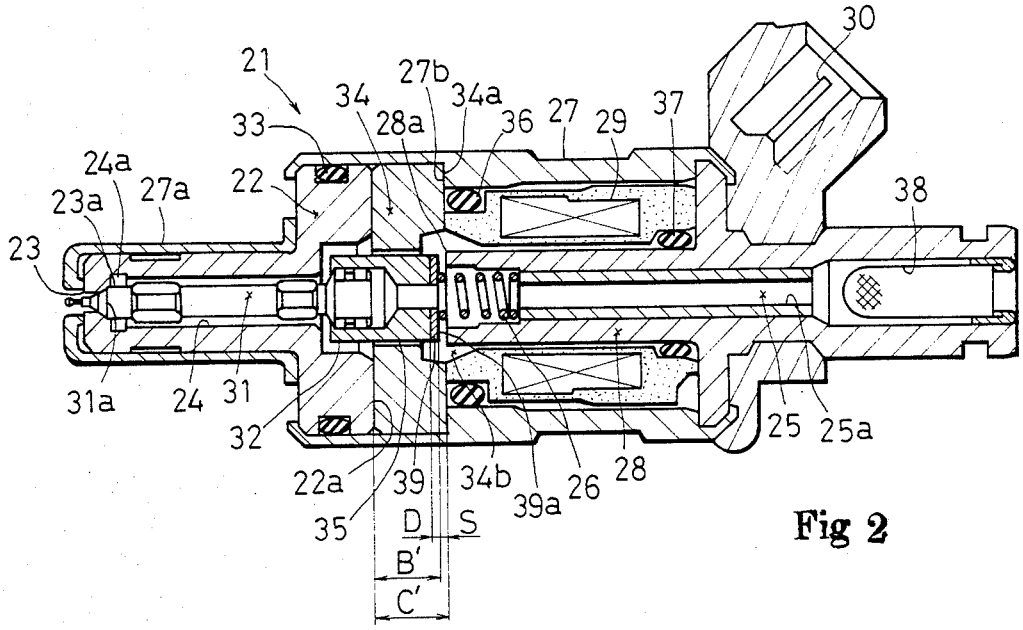
FIG. 2 is a vertical cross-sectional view of an electromagnetic fuel injector according to the first preferred embodiment of the present invention.
Figure 4:
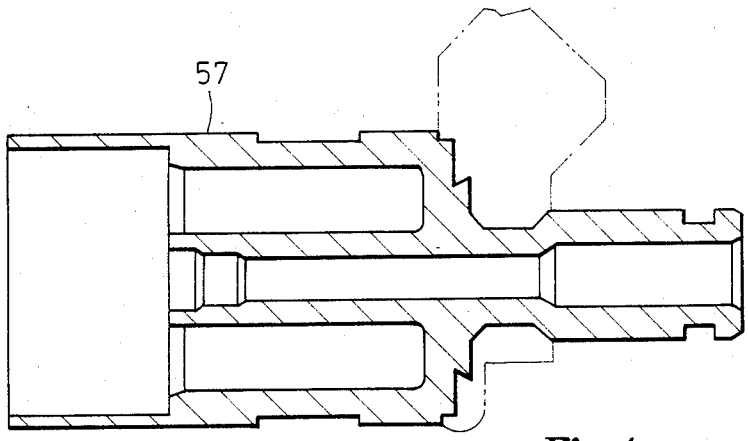

Referring now to FIG. 2, reference numeral 21 designates an electromagnetic fuel injector of the invention. Reference numeral 22 designates a valve housing which is provided with a fuel injection nozzle 23 at its front end and with a guide hole 24 in the central axial bore. A pressurized fuel chamber 24*a* is defined between the fuel injection nozzle 23 and the front end of the guide hole 24. Reference numeral 31 designates a plunger-like valve body which is slidably received in the guide hole 24 and is combined with an armature 32 at its rear end. A non-magnetic spacer 39 is fixed to the rear end of the armature 32 for cutting off the residual magnetism of the fixed magnet core 28. The front outside portion of the valve housing 22 is protected by the cover 27*a* and the rear portion of the valve housing 22 is fixed through an O-ring seal 33 at its outer periphery and a ferromagnetic spacer 34 having a fixed thickness at its rear end to the abutting surface 27*b* of an electromagnetic housing 27. A fuel passage 35 is bored through the central portion of the spacer 34. The rear end 34*a* of the spacer 34 is cut out around the central bore so as to form an annular groove 34*b* for preventing short of magnetism. The electromagnetic housing 27 is formed of ferromagnetic material and includes an exciting coil 29 surrounding the fixed magnet core 28 with an O-ring seals 36 and 37 interposed. The fixed magnet core 28 is also formed of ferromagnetic material and includes a fuel passage 25 bored through its central portion, and is fixed to the rear portion of the electromagnetic housing 27. The electromagnetic housing 27 and the fixed magnet core 28 may be integrally formed as shown by the reference numeral 57 in FIG. 4. A terminal 30 for the exciting coil 29 is provided at the rear outside portion of the fixed magnet core 28.

The abutting surface 27*b* of the electromagnetic housing 27 is flush with the front end 28*a* of the fixed magnet core 28. Accordingly, the stroke S of the valve body 31 is determined in such a manner that the valve member 31*a* of the valve body 31 abuts against the valve seat 23*a* and each rear end of the valve housing 22 and the armature 32 is adjusted after assembling the valve housing 22, the valve body 31, the armature 32 and the spacer 34. The distance between the rear end 22*a* of the valve housing 22 and the rear end 39*a* of the non-magnetic spacer 39 is shown by B′ and the fixed thickness of the ferromagnetic spacer 34 is shown by C′. The relation between B′ and C′ is expressed by the equation $B'+S=C'$. The sleeve 25*a* of the fixed magnet core 28, the compression spring 26 and the fuel filter 38 are identical with those used in the prior art.

Figure 3:
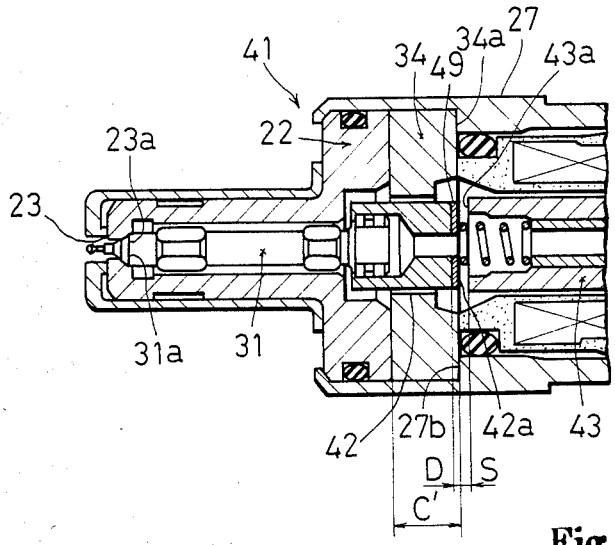
FIGS. 3 and 4 are vertical cross-sectional views of the essential part of the electromagnetic fuel injector according to other embodiments.

FIG. 3 shows an essential part of the electromagnetic fuel injector according to the second embodiment. The basic constitution of this embodiment is substantially identical with that of the first preferred embodiment, however, the following points are different. In the electromagnetic fuel injector 41, the valve member 31*a* of the valve body 31 abuts against the valve seat 23*a*, and the valve housing 22, the valve body 31, the armature 42 and the spacer 34 are assembled. With this arrangement, the rear end 42*a* of the non-magnetic spacer 49 is flush with the rear end 34*a* of the ferromagnetic spacer 34. Accordingly, the stroke S of the valve body 31 is determined in such a manner that the abutting surface 27*b* of the ferromagnetic housing 27 and the front end 43*a* of the fixed magnetic core 43 are adjusted after combining the electromagnetic housing 27 with the fixed magnet core 43.

As hereinabove described, the air gap D is accurately determined by fixing the non-magnetic spacers 39 and 49 having a fixed thickness to the rear end of the armatures 32 and 42, respectively. In the first preferred embodiment, as to the maximum stroke S of the valve body 31, since the abutting surface 27*b* of the electromagnetic housing 27 and the front end 28*a* of the fixed magnet core 28 are simultaneously finished to a flush plane, the axial dimension does not have to be measured, and as a result, no errors in measurement arise. As the thickness C′ of the ferromagnetic spacer 34 is constant, the maximum stroke S is determined only by the relative relation between the rear end 22*a* of the valve housing 22 and the rear end 39*a* of the armature 32 including a non-magnetic spacer 39, and as a result, the stroke S may be determined with reduced errors in measurement. In the second embodiment, the stroke S may be also determined with a high degree of accuracy as is similar to the first preferred embodiment.

In quantitative analysis of the above-mentioned effect, the errors in measurement in the prior art are $A\pm2.5$ μm, $B\pm1.5$ μm and $C\pm0.5$ μm which are the best values obtained in a usual mass production and the combined errors expressed by the root-mean-square value is $\sqrt{2.5^2+1.5^2+0.5^2}\approx3$ μm. On the other hand, according to the present invention, the errors in measurement are $A'\pm0$, $B'\pm1.5$ μm and $C'\pm0.5$ μm, and the combined error is $\sqrt{1.5^2+0.5^2}\approx1.6$ μm which is about half the value obtained in the prior art. Correspondingly, the scatter of fuel flow in the electromagnetic fuel injector is improved by ±5.5% and the scatter of the valve opening time $\tau_{min}$ and $\tau_{max}$ is secondarily decreased.

In operation, the presurrized fuel is supplied through the fuel filter 38 and the fuel passages 25, 35 and 24 to the fuel chamber 24*a*. The valve body 31 is normally biased by the compression spring 26 and the fuel injection nozzle 23 is maintained in the closed position. When the control signal for opening the valve body is inputted from a computer (not shown) to the exciting coil 29, a magnetic field is generated at the electromagnetic housing 27 and the fixed magnet core 28, and the armature 32 is attracted. As a result, the valve body 31 is moved rearwardly, and the clearance is created between the valve seat 23*a* and the valve member 31*a*, thereby injecting the pressurized fuel in the fuel chamber 24*a* from the fuel injection nozzle 23. The axial dimension of the clearance is the stroke S which is determined with a high degree of accuracy as hereinabove described, so that the scatter of the fuel flow metered at the clearance is remarkably reduced.

Having thus described the preferred embodiment of the invention it should be understood that numerous structural modifications and adaptations may be restored to without departing from the spirit of the invention.

What is claimed is:

1. In combination with an electromagnetic fuel injector for an internal combustion engine including a valve housing provided with a fuel injection nozzle and a valve seat at its front end and a guide hole extending along the axis of said valve housing, a valve body slideable axially in said guide hole, a compression spring adapted to normally urge said valve body in a direction toward said valve seat so as to close said fuel injection nozzle, an armature fixed to the end of said valve body furthest from said nozzle, a fixed magnet core having a front end opposite to the rear end of said armature and having a fuel passage extending through its central portion, an exciting coil surrounding said fixed magnet core, and a magnetic housing enclosing said valve housing and said fixed magnet core and having an internal mounting shoulder, said electromagnetic fuel injector being adapted to discharge pressurized fuel when said exciting coil receives a control signal to open said valve body; the improvement comprising a non-magnetic spacer fixed to the end of said armature furthest from said nozzle for cutting off residual magnetism of said fixed magnet core, and a ferromagnetic spacer having a fixed thickness interposed between the rear end surface of said valve housing and the shoulder of said magnetic housing, wherein a front end of said fixed magnet core is flush with the shoulder of said magnetic housing, and the end of said armature furthest from said nozzle and the rear end surface of said valve housing are machined so that in their positions under a fully closed condition of said valve body, they provide a maximum stroke of said valve body.

2. In combination with an electromagnetic fuel injector for an internal combustion engine including a valve housing provided with a fuel injector nozzle and a valve seat at its front end and a guide hole extending along the axis of said valve housing, a valve body slideable axially in said guide hole, a compression spring adapted to normally urge said valve body in a direction toward said valve seat so as to close said fuel injection nozzle, an armature fixed to the end of said valve body furthest from said nozzle, a fixed magnet core having a front end opposite to the rear end of said armature and having a fuel passage extending through its central portion, an exciting coil surrounding said fixed magnet core, and a magnetic housing enclosing said valve housing and said fixed magnet core and having an internal mounting surface, said electromagnetic fuel injector being adapted to discharge pressurized fuel when said exciting coil receives a control signal to open said valve body; the improvement comprising a non-magnetic spacer fixed to the end of said armature furthest from said nozzle for cutting off residual magnetism of said fixed magnet core, and a ferromagnetic spacer having a fixed thickness interposed between the rear end surface of said valve housing and the mounting surface of said magnetic housing, wherein a rear end of said non-magnetic spacer is flush with a rear end of said ferromagnetic spacer, and the front end of said fixed magnet core and the mounting surface of said magnetic housing are machined so that in their positions under a fully closed condition of said valve body, they provide a maximum stroke of said valve body.

* * * * *